US006318052B1

(12) United States Patent
Kuhar

(10) Patent No.: US 6,318,052 B1
(45) Date of Patent: Nov. 20, 2001

(54) APPARATUS FOR REMOVING AND FURTHER CONVEYING A BAG FROM A STACK OF BAGS

(75) Inventor: Milan Kuhar, Vienna (AT)

(73) Assignee: Waagner-Biro Binder AG, Gleisdorf (AT)

( * ) Notice: Subject to any disclaimer, the term of this patent is extended or adjusted under 35 U.S.C. 154(b) by 0 days.

(21) Appl. No.: 09/656,887

(22) Filed: Sep. 7, 2000

(30) Foreign Application Priority Data

Sep. 8, 1999 (AT) ..... 1543/99

(51) Int. Cl.[7] ..... B65B 43/26
(52) U.S. Cl. ..... 53/570; 53/571
(58) Field of Search ..... 53/64, 67, 389.1, 53/570, 571, 389.5; 271/11, 14, 94

(56) References Cited

U.S. PATENT DOCUMENTS 3,777,558 12/1973 Bain ..... 73/105
4,495,746 * 1/1985 Focke et al. ..... 53/389.5
4,516,762 * 5/1985 Moltrasio et al. ..... 271/11
4,545,184 * 10/1985 Akiyama ..... 53/571
4,643,412 * 2/1987 Heina et al. ..... 271/94
5,836,581 * 11/1998 Vernackt ..... 271/11

FOREIGN PATENT DOCUMENTS 37 42 637 6/1989 (DE) .
38 06 419 9/1989 (DE) .
375260 7/1932 (GB) .

* cited by examiner

*Primary Examiner*—Peter Vo
*Assistant Examiner*—Nathaniel Chukwurah

(57) ABSTRACT

An apparatus for removing a bag (5) which is open on one side (5) from a stack (2) of such bags which are preferably stored in a bag hopper (1), this being by means of a lifting and suction apparatus, whereby the lifting and suction apparatus is a preferably driven conveyor belt (3) and for further conveying the bag (5) to a position for further processing. In order to enable a high throughput rate of the bags to be removed and to enable the realization of a position for further processing which is variably adaptable to the system requirements or can be optionally horizontal, vertical or in between, it is provided that the lifting and suction apparatus is horizontally and vertically movable to accelerate the removing of the bags.

7 Claims, 6 Drawing Sheets

APPARATUS FOR REMOVING AND FURTHER CONVEYING A BAG FROM A STACK OF BAGS

BACKGROUND OF THE INVENTION

1. Field of the Invention

The present invention relates to an apparatus for removing and conveying a bag from a stack of bags.

2. Description of the Prior Art

DE 38 06 419 A1 discloses such an apparatus in which the bag to be removed is sucked against a conveyor belt which then conveys the bag to a predefined position. However the further handling possibilities of the so conveyed bag are very limited since the bag has to be released at a predefined position. The operating area of such a device is therefore very small and the throughput capacity of these known apparatuses are rather low.

In known apparatuses of this kind the uppermost bags of a stack of bags stored in a bag hopper are removed by means of a (swivelable) gripper arm which is provided with a suction function, are lifted and thus separated from the remaining stack of bags.

It is known from GB 375.260 A to lift the uppermost bag of such a stack of bags by means of a vacuum gripper arm through the gaps of a chain conveyor, with the chains of the chain conveyor being connected with rods and the arrangement of rods being interrupted by one or several gaps. The uppermost bag is held for such a time until the entire bag is driven underneath by a revolving rod arrangement which is separated by the gaps. The bag is then released and conveyed by the chain conveyor to a position for further processing.

The disadvantage of these known apparatuses is the fact that only very limited throughput capacities are possible because there are only very few gaps in the chain conveyor and that the chain conveyor can only be driven at low speed because the bags to be conveyed only rest on the chain conveyor, which leads to the danger for particularly light bags that they will fall down due to the air stream produced by the chain conveyor.

Solutions are also known where the bag is swiveled by a vacuum gripper arm from a horizontal plane to a vertical plane from where it is conveyed by means of further conveying means to an end position (e.g. a filling station).

The disadvantage also arises in said known solutions of a very low throughput due to the mechanical structure of such a gripper. Moreover, the conveyance of the bag to be removed to a horizontal position with a vacuum gripper can only be realized in a very complicated manner.

SUMMARY OF THE INVENTION

It is therefore the object of the present invention to provide an apparatus of the kind mentioned above which allows an increase in the throughput of the bags to be removed and brings the removed bag either in a horizontal, vertical or intermediate position for further processing.

This is achieved in accordance with the invention with an apparatus for removing a bag from a stack of bags, which comprises an apparatus for lifting the bag from the stack by suction and for conveying the bag in a conveying direction to a position for further processing or filling. The apparatus for lifting and conveying the bag comprises a driven conveyor belt between whose upper and lower strand there is arranged a device for producing a sub-atmospheric pressure for pressing the removed bag against the lower conveyor belt strand. The conveyor belt is driven about two deflection rollers and the two deflection rollers are mounted on two movable arms forming a parrallelogram mechanism whereby the two arms convey the conveyor belt from a first position, in which the bag is sucked against the lower conveyor belt strand to the position for further processing or filling, and the conveyor belt and the device for producing the sub-atmospheric pressure is held horizontally and vertically movable to accelerate the removing of the bag.

As a result, the conveyor belt can be lifted together with the device for producing the sub-atmospheric pressure, and the removed bag can be lifted or swiveled into a position for further processing. The removed bag can subsequently be conveyed away, simultaneously with, or subsequently to, the lifting/swiveling, depending on the length of the conveyor belt, in a horizontal direction at high speed by means of the conveyor belt. The sub-atmospheric pressure ensures that the empty bags cannot slip off the conveyor belt. The combined horizontal and vertical (lifting/lowering and swiveling) movement of the removed bag allows the position of the bag always to remain horizontal.

The mounting of the deflection rollers of the conveyor belt on a parallelogram mechanism enables the bag to be lifted rapidly off the stack of bags, and the removed bag to be conveyed horizontally by the conveyor belt.

According to another feature, a first supporting roller is arranged downstream of the conveyor belt in the conveying direction for pressing against the conveyor belt in the position for further processing or filling, a pivotal lever having two arms is provided, the two lever arms having free ends, an adjusting device is connected to the free end of one of the lever arms, the first supporting roller being mounted on the free end of the other lever arm, another lever is rotatable about a pivot, and a connecting rod rigidly connects the other lever arm to the pivot.

This allows the bag, which has already been removed from the stack and further conveyed on the conveyor belt, to be drawn between a deflection roller of the conveyor belt and the first supporting roller. This allows performing the further manipulation of the bag in a relatively simple manner, with the deflection roller and the first supporting roller acting as feeding means for the further apparatuses provided for further processing. The first supporting roller is adapted precisely to the position of the conveyor belt in order to ensure the optimal drawing-in of the removed bag.

Further processing and handling of the bag in a simple manner can be accomplished by providing a second supporting roller mounted on a free end of the other lever for pressing against the first supporting roller. The removed bag can be handled further in a horizontal as well as vertical position.

BRIEF DESCRIPTION OF THE DRAWING

The invention is now explained in closer detail by reference to the enclosed drawings, wherein:

FIG. 3 shows a schematic side view of the invention in which the bag was brought to a freely suspended position;

Detailed Description of Preferred Embodiments

Figure 1:
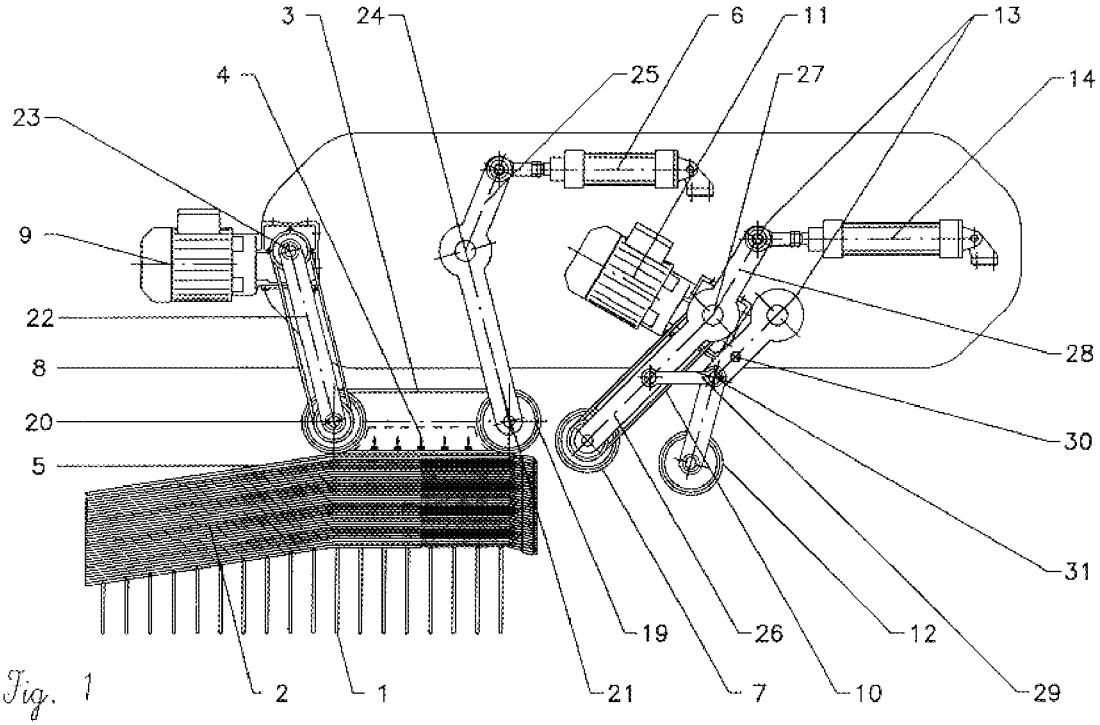
FIG. 1 shows a schematic side view of the apparatus in the initial position.

In FIG. 1 a stack of bags 2 is placed on a hopper grating 1. Depending on the bags that are used, the hopper grating or the all-enclosed bag hopper (not shown) is arranged in such a way that at least a part of the bag surfaces form a horizontal plane. The apparatus in accordance with the invention is arranged above the hopper grating 1 and the stack of bags 2. It comprises a conveyor belt 3 between whose upper and lower strand there is arranged an apparatus 4 to produce a pressure below atmospheric (hereinafter referred to as suction box).

The two deflection rollers 19, 20 are arranged on movably held arms 21, 22 according to the invention.

Arm 22 is rotatably held in its end zone 23. The deflection roller 20 and thus the conveyor belt 3 are driven by way of a enveloping means drive 8 which is driven by way of a motor gearbox combination 9.

The arm 21 is an arm of a two-part lever 24 whose other arm 25 is connected in its end zone with an adjusting apparatus 6, which in the present case is a pneumatically or hydraulically actuated cylinder.

The arm 21 of the two-arm lever 24 and the arm 22 form parallelogram mechanism according to the known principle.

As seen downstream in the conveying direction of the conveyor belt there is provided a multi-joint mechanism 13 which is responsible for the further manipulation of the removed bag. It comprises a supporting roller 7 which is arranged on an arm 26 of a two-arm lever 27 and which can be rotated by way of an enveloping means drive 10 which is driven via a motor-gearbox combination 11. The other arm 28 of the two-arm lever 27 is connected in its free end zone with an adjusting device 14, which in the present case is also a cylinder which can be actuated pneumatically or hydraulically. Arm 26 of the two-arm lever 27 is further rigidly connected via a connecting rod 29 with the joint 31 of an articulated lever 30 in whose free end zone there is arranged a further supporting roller 12.

If a bag 5 is to be removed now from the stack of bags 2, the conveyor belt 3 with the suction box 4 is lowered onto the uppermost bag 5. At the same time, a pressure below atmospheric is produced in the known manner in the suction box 4. In this way the bag 5 is sucked against the conveyor belt 3. Thereafter there is a swiveling movement of the parallelogram mechanism through an activation of the adjusting apparatus 6. Bag 5 always sticks to conveyor belt 3 and remains in the horizontal position.

Figure 2:
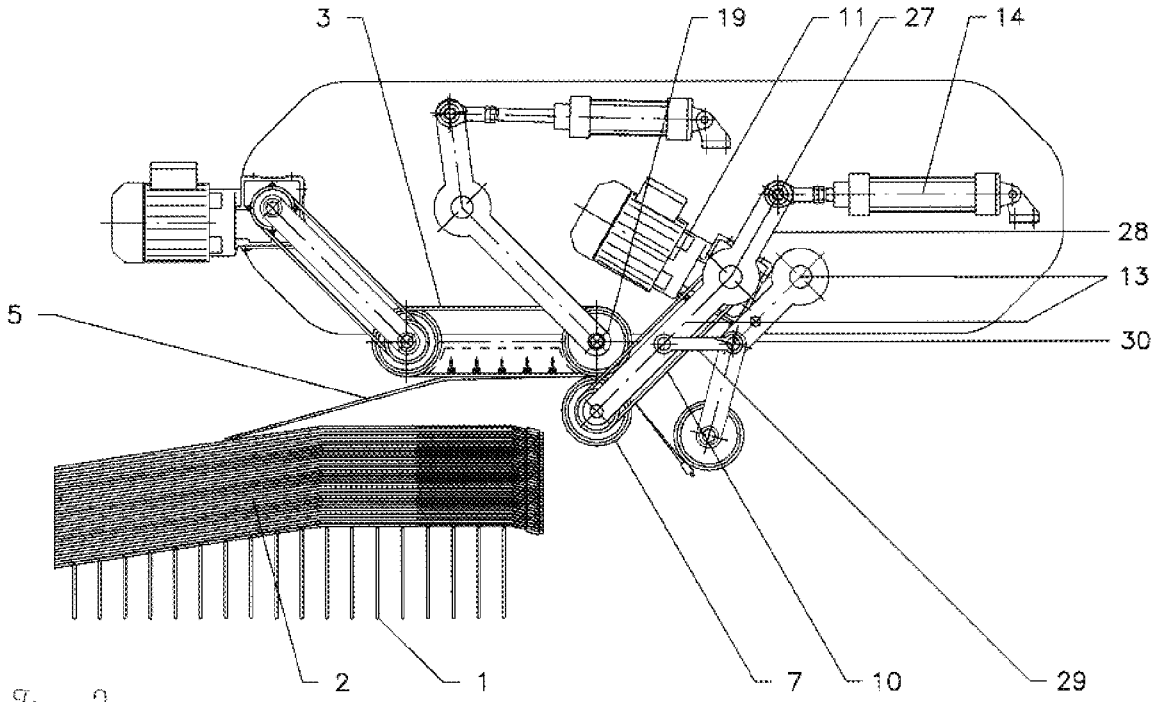
FIG. 2 shows a schematic side view of the invention in the draw-in position.

The swiveling movement is continued until reaching a position for further processing (FIG. 2). In the position for further processing the deflection roller 7 which is driven by the motor 11 and the enveloping means drive 10 is pressed against the deflection roller 19 of the conveyor belt 3 as a result of the activation of the adjusting apparatus 14, with the conveyor belt 3 thereupon being activated, thus drawing the bag 5 into the gap between the deflection roller 7 and the deflection roller 19 (FIG. 2).

Thereafter the arm 28 of the two-arm lever 27 is moved by the actuation of the adjusting apparatus 14 and, consequently, the entire multi-joint mechanism 13. The movement of the two-arm lever 27 is transmitted onto the articulated lever 30 by way of the connecting rod 29.

Figure 4:
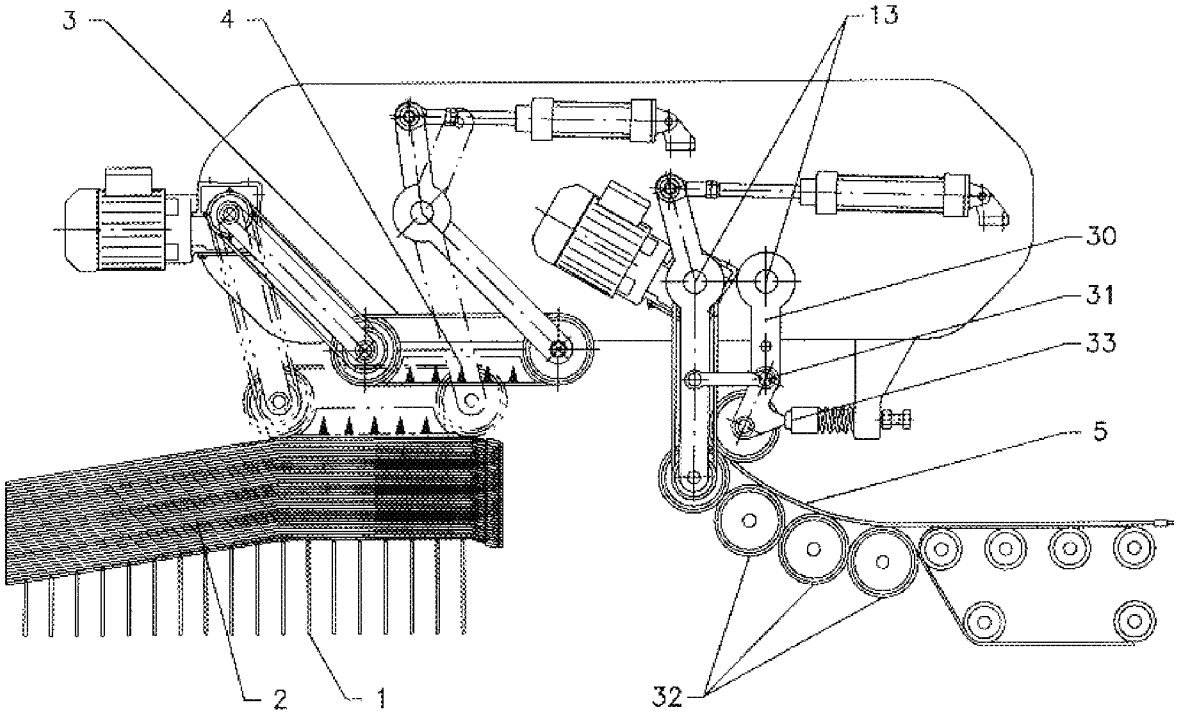
FIG. 4 shows a schematic side view of the invention in which the bag was brought into a horizontal position for further processing.
Figure 5:
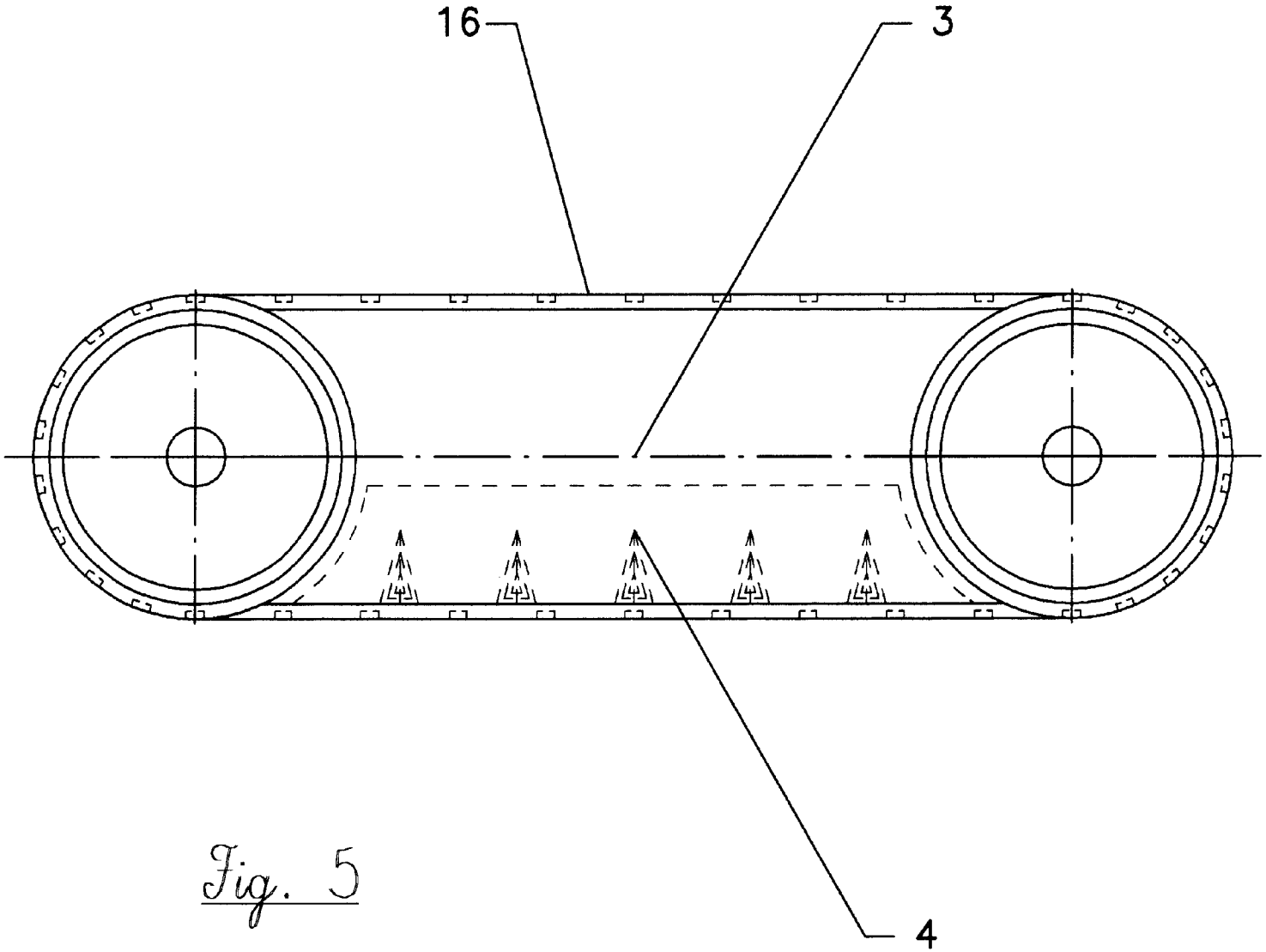

The extension of the adjusting apparatus 14 produces a movement of the multi-joint mechanism 13 in such a way that the same is moved to one of several end positions (FIGS. 3, 4). The removed bag is held in this process between the rollers 7 and 12 and can be conveyed to such an extent in the vertical direction as is required for the further processing (FIG. 3). The precise vertical position of the bag 5 is determined by the bag position detectors 15 for example.

The parallelogram mechanism with conveyor belt 3 and suction box 4 can be moved to the initial position again (FIG. 1) from the time at which bag 5 has left the conveyor belt 3 and can remove a new bag 5 from stack 2 while the multi-joint mechanism 13 moves to the end position (FIG. 3).

FIG. 4 shows another possibility of arranging the multi-joint mechanism 13 in a further possible end position. The articulated lever 30 is provided with a different proportioning of the joint 31 than in FIG. 3. During the downward swiveling of the multi-joint mechanism 13 the lower part of the articulated lever 30 which carries the pressure roller 12 comes to rest on a resilient and adjustably held stop 33, thus defining the respective end position of the multi-joint mechanism.

This allows bringing the removed bag 5 to a horizontal depositing position via further deflection rollers 32, from where the bag 5 can be collected by a push-on swiveling apparatus (not shown).

Figure 5:
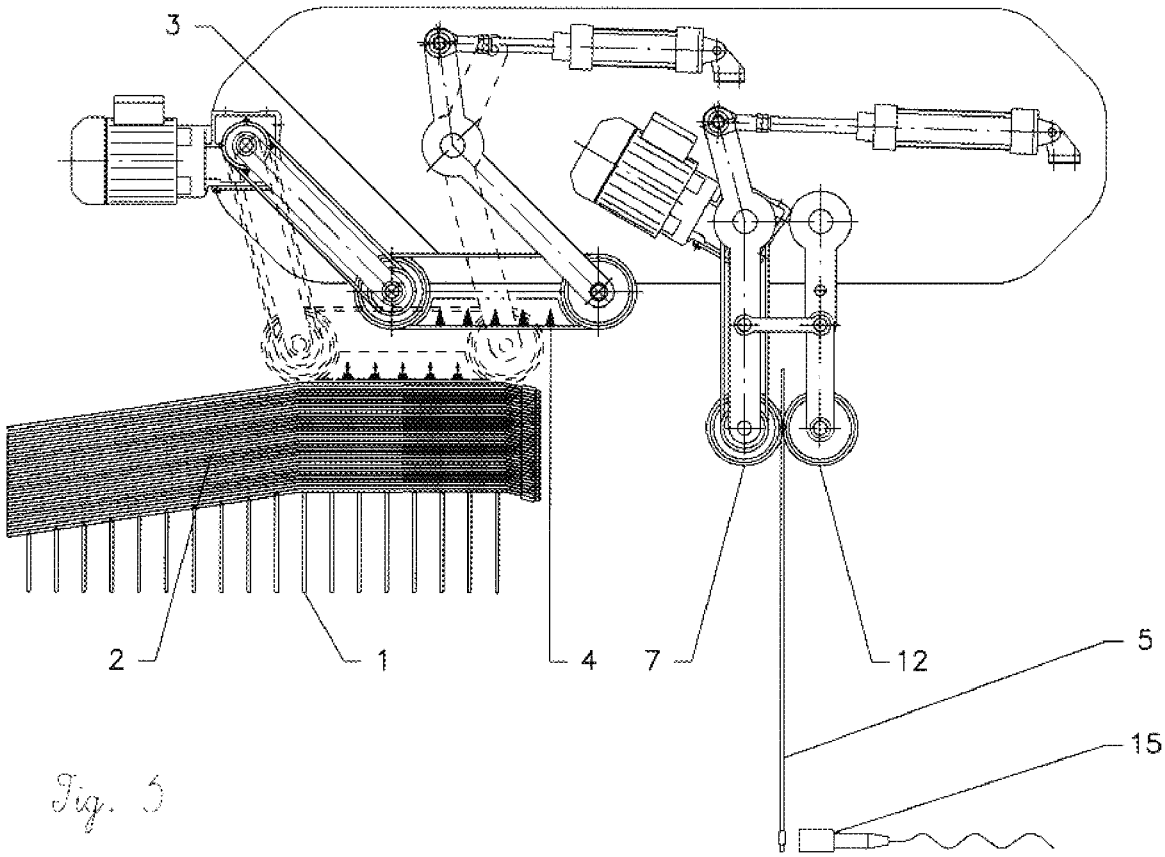
FIG. 5 shows a possible embodiment of the belt in a side view
Figure 6:
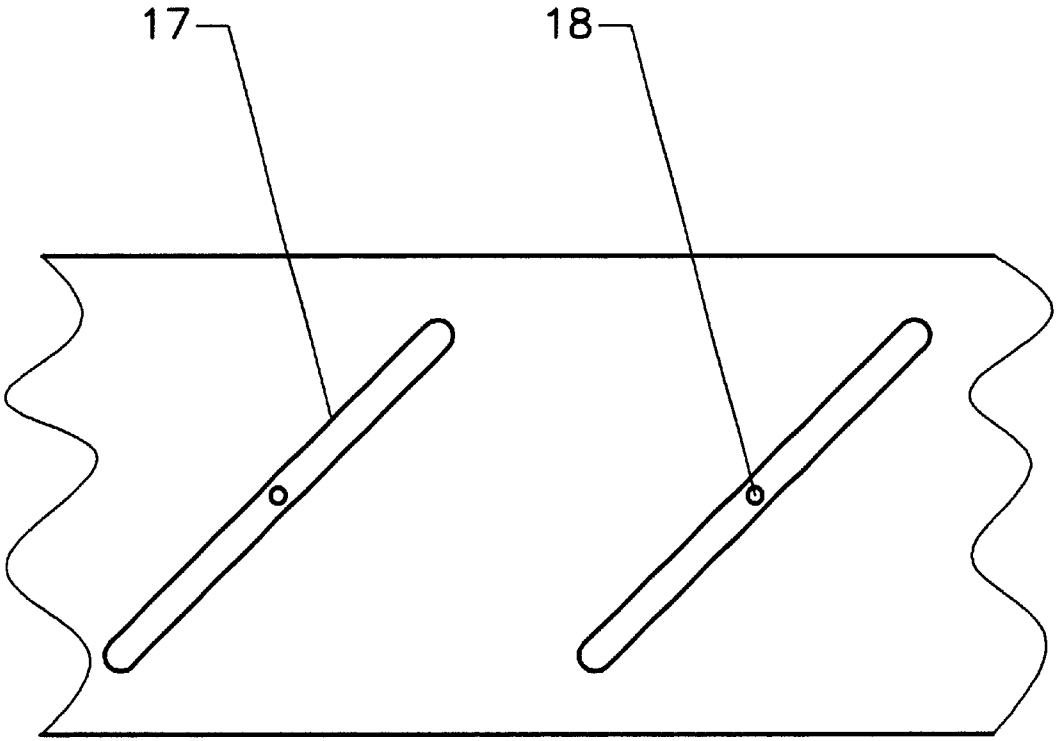
FIG. 6 shows a possible embodiment of the belt in a top view

FIGS. 5 and 6 show a possible embodiment of the belt 16 of the conveyor belt 3. Belt 16 is provided with suction grooves 17 which extend inclined to the longitudinal axis of the belt. The transmission of the pressure below atmospheric from the suction box 4 to the suction grooves 17 is performed via openings 18 which are arranged in the middle of the belt. As an alternative thereto it is also possible to use a porous, highly gas-permeable fabric belt or a belt made of loosely woven fabric with a defined distance between warp and weft of the fabric.

What is claimed is:

1. An apparatus for removing a bag from a stack of bags, which comprises an apparatus for lifting the bag from the stack by suction and for conveying the bag in a conveying direction to a position for further processing or filling, the apparatus for lifting and conveying the bag comprising a driven conveyor belt between whose upper and lower strand there is arranged a device for producing a sub-atmospheric pressure for pressing the removed bag against the lower conveyor belt strand, the conveyor belt being driven about two deflection rollers and the two deflection rollers being mounted on two movable arms forming a parallelogram mechanism whereby the two arms convey the conveyor belt from a first position, in which the bag is sucked against the lower conveyor belt strand to the position for further processing or filling, and the conveyor belt and the device for producing the sub-atmospheric pressure is held horizontally and vertically movable to accelerate the removing of the bag.

2. The apparatus of claim 1, wherein one of the arms has one rotatably mounted end and an opposite free end on which one of the deflection rollers is mounted.

3. The apparatus of claim 2, wherein the other arm is a pivotal lever having two arms, the lever arms having free ends, an adjusting device being connected to the free end of one of the lever arms, and another one of the deflection rollers being mounted on the free end of the other lever arm.

4. The apparatus of claim 3, wherein the adjusting device is a pressure fluid-operated cylinder.

5. The apparatus of claim 1, further comprising a drive connected to at least one of the deflection rollers.

6. The apparatus of claim 1, further comprising a first supporting roller arranged downstream of the conveyor belt in the conveying direction for pressing against the conveyor belt in the position for further processing or filling, a pivotal lever having two arms, the two lever arms having free ends, an adjusting device connected to the free end of one of the lever arms, the first supporting roller being mounted on the free end of the other lever arm, another lever rotatable about a pivot, and a connecting rod rigidly connecting the other lever arm to the pivot.

7. The apparstus of claim 6, comprising a second supporting roller mounted on a free end of the other lever for pressing against the first supporting roller.

* * * * *